United States Patent [19]

Stauber

[11] Patent Number: 4,616,816

[45] Date of Patent: Oct. 14, 1986

[54] APPARATUS FOR SUPERPOSING FLEXIBLE FLAT STRUCTURES, ESPECIALLY SHEETS AND SIGNATURES, AND METHOD OF USING SUCH APPARATUS

[75] Inventor: Hans-Ulrich Stauber, Grüt, Switzerland

[73] Assignee: Ferag AG, Hinwil, Switzerland

[21] Appl. No.: 778,615

[22] Filed: Sep. 23, 1985

[30] Foreign Application Priority Data

Sep. 24, 1984 [CH] Switzerland ..... 4561/84

[51] Int. Cl.[4] ..... B65H 39/02

[52] U.S. Cl. ..... 270/58; 271/4; 271/9; 271/267

[58] Field of Search ..... 270/58; 271/4, 9, 256, 271/259, 264, 265, 267, 268, 272

[56] References Cited

U.S. PATENT DOCUMENTS

| | | | |
|---|---|---|---|
| 3,583,696 | 6/1971 | Runzi | 271/4 |
| 3,807,723 | 4/1974 | Thomas | 271/9 |
| 4,153,242 | 5/1979 | Mizuma | 271/9 |
| 4,157,822 | 6/1979 | Miller | 271/9 |
| 4,244,564 | 1/1981 | Brown | 270/58 |
| 4,465,192 | 8/1984 | Ohba et al. | 271/9 |
| 4,471,954 | 9/1984 | Bourg | 270/58 |
| 4,560,293 | 12/1985 | McCumber et al. | 271/9 |

*Primary Examiner*—E. H. Eickholt

*Attorney, Agent, or Firm*—Werner W. Kleeman

[57] ABSTRACT

Underneath a support table for a cover element or sheet there are positioned a number of receiving or storage bins for additional or supplementary sheets. Between the receiving or storage bins and the support table there is placed a conveyor belt. One run of the conveyor belt is pressed against the underside of the support table. A thrust element for advancing the cover element is coupled with the conveyor belt. A piston-cylinder unit displaces the conveyor belt and the thrust element in a direction of movement towards a deposit device. During this displacement the one run of the conveyor belt rolls at the support table, whereby the conveyor belt is circulatingly driven. A first or active-conveying run of the conveyor belt withdraws additional or supplementary sheets, which have been pushed into the movement path or working range of the conveyor belt, from the receiving or storage bins and transports them towards the deposit device. The speed at which these additional or supplementary sheets are transported, is twice the advance speed of the cover element. Thus it is ensured that the additional or supplementary sheets come to rest beneath the cover element.

12 Claims, 3 Drawing Figures

APPARATUS FOR SUPERPOSING FLEXIBLE FLAT STRUCTURES, ESPECIALLY SHEETS AND SIGNATURES, AND METHOD OF USING SUCH APPARATUS

CROSSREFERENCE TO RELATED APPLICATION

This application is related to the commonly assigned, copending U.S. patent application, Ser. No. 06/778,810, filed Sept. 23, 1985, and entitled "APPARATUS FOR PLACING FLAT COVER ELEMENTS, PREFERABLY COVER SHEETS, ON STACKS OF FLAT ARTICLES, PREFERABLY PRINTED PRODUCTS".

BACKGROUND OF THE INVENTION

The present invention relates to a new and improved construction of an apparatus for superposing flexible flat structures or entities, especially sheets and signatures.

In its more particular aspects, the present invention specifically relates to a new and improved construction of an apparatus for superposing flexible flat structures or entities, especially sheets and signatures, and comprises at least one receiving or storage bin which is open toward the top, for accommodating a supply of flat structures or entities. The at least one storage bin is arranged below a conveying path or track which leads to a deposit device or means for the flat structures or entities which have been collected one above the other.

In collating machines or installations of this type the path of movement or conveying path or track of the collecting means extends in a horizontal plane. A number of receiving or storage bins for accommodating stacks of sheets or signatures which have to be collated, are arranged below the aforementioned path of movement or conveying path or track. These receiving or storage bins are inclined relative to the vertical and therefore are also inclined relative to the path of movement or conveying path or track of the collecting means. By means of suitable feed or outfeed mechanisms, single sheets or signatures are upwardly displaced or pushed from all or only selected ones of the receiving or storage bins and are brought into the operating or working range of the collecting means. The collecting means is moved across the receiving or storage bins and pulls the sheets or signatures which have been upwardly displaced or pushed off the stacks. Each newly withdrawn or extracted sheet or signature comes to rest below the precedingly withdrawn or extracted sheets or signatures. In such collating machines or installations the withdrawal and conveyance of the sheets or signatures can only be effected with the movement speed of the collecting means.

A prior art construction of collating machine is disclosed in U.S. Pat. No. 3,584,865, granted June 15, 1971.

SUMMARY OF THE INVENTION

Therefore, with the foregoing in mind, it is a primary object of the present invention to provide a new and improved construction of an apparatus for superposing flexible flat structures or entities, especially sheets and signatures, and which enlarges and enhances the scope of use of such apparatus.

Now in order to implement this and still further objects of the invention, which will become more readily apparent at the description proceeds, the apparatus of the present development is manifested by the features that, the collecting means or installation contains at least one endless conveyor belt which is circulatingly drivable by means of a first run which faces the at least one receiving or storage bin and which is movable in the direction of movement of the conveyor belt.

Since the circulation or revolving speed of the conveyor belt need not be the same as the speed with which the conveyor belt moves or advances along the conveying path or track, it is possible to adapt or adjust to prevailing conditions and within certain limits, the conveying speed of the sheets or signatures or the like which are to be conveyed to the deposit device or means in a superposed condition.

In a preferred and constructionally especially simple embodiment, the conveyor belt engages by means of a second run a preselected, preferably stationary structural member or component. During movement along the conveying path or track the conveyor belt is driven due to the rolling movement of this second run at the stationary structural member or component. This now has the result that the conveying speed of the flat structures or entities which have been withdrawn or extracted from the receiving or storage bins, is twice as high as the movement speed of the conveyor belt. Furthermore, this renders unnecessary a separate drive unit for the conveyor belt.

Advantageously there is arranged above the conveyor belt a support or support table for further flat structures or entities constituting cover elements or sheets and which support or support table defines a predetermined travel path leading to the deposit device or means. There is also provided a displacing device or means for displacing these further flat structures or entities along this predetermined travel path to the deposit device or means. In such an embodiment it is thus possible to bring together, in a simple manner, flat structures or entities which do not originate from the receiving or storage bins arranged underneath the conveying path or track, but are delivered from a different source, for example, from a printing press, with the flat structures or entities withdrawn or extracted from the receiving or storage bins. This collating or assembling operation is performed in such a manner that the last mentioned flat structures or entities lie underneath the first mentioned flat structures or entities originating from the different source.

BRIEF DESCRIPTION OF THE DRAWINGS

The invention will be better understood and objects other than those set forth above, will become apparent when consideration is given to the following detailed description thereof. Such description makes reference to the annexed drawings wherein throughout the various figures of the drawings there have been generally used the same reference characters to denote the same or analogous components and wherein.

DETAILED DESCRIPTION OF THE PREFERRED EMBODIMENTS

Figure 1:
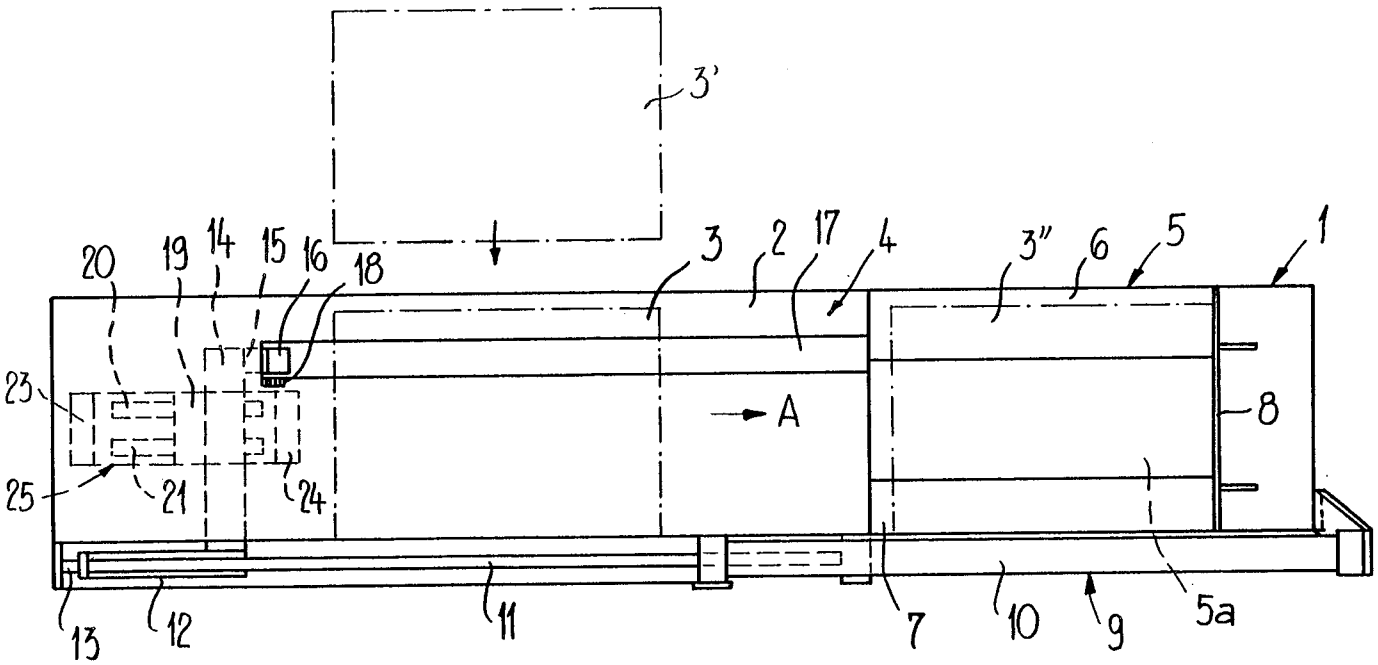
FIG. 1 is a top plan view of an exemplary embodiment of the inventive apparatus for collating a cover element or sheet and additional or supplementary sheets lying below the cover element or sheet.

Describing now the drawings it is to be understood that only enough of the construction of an exemplary embodiment of the collating apparatus according to the invention has been shown as needed for those skilled in the art to readily understand the underlying principles and concepts of the present development while simplifying the showing of the drawings. Turning attention now specifically to the collating apparatus depicted in the drawings by way of example and not limitation, such collating apparatus contains a frame 1 with a support or support table 2 for further flat structures or entities constituted by cover elements or sheets 3. The support or support table 2 constitute a preselected structural member with a specific function for a conveyor belt 25 which will be described in detail hereinafter.

A deposit device or means 5 follows the support or support table 2 which defines a travel path or track 4 for the cover elements or sheets 3. This deposit device or means 5 contains two support rails 6 and 7 which therebetween form an opening 5*a* and which lie opposite to each other, as well as a stop 8. The cover elements or sheets 3 are delivered by a not specifically illustrated source and are placed onto the support or support table 2. In FIG. 1 there is designated by reference character 3' a cover element or sheet which, for example, comes from a printing press or installation of known construction and, in this printing press or installation, this cover element or sheet 3' has been provided, for example, with dispatch or shipping data. If desired, the cover elements or sheets 3 are cut to size before they are placed on the support or support table 2.

Furthermore, there are present drive means 9, 10, 11 containing a piston-cylinder unit 9 with a cylinder 10 which is secured to the frame 1 in a reposing position.

A connecting member or piece 12 is connected with a piston rod 11 of the aforementioned piston-cylinder unit 9 and is lengthwise guided by means of a guide rod 13 which extends in the longitudinal direction of the piston-cylinder unit 9. A transverse beam or carrier 14 of collecting means 14, 16, 25 is connected with this connecting member or piece 12 and carries at its free end an extension or bracket 15, see FIG. 1. To this extension or bracket 15, there is secured a thrust element 16 of the collecting means 14, 16, 25 and which extends through an opening 17 in the support or support table 2. Both the transverse carrier or beam 14 as well as the extension or bracket 15 extend underneath the support or support table 2. Furthermore, there is rotationally mounted at the thrust element 16, a support roll 18 which bears upon the top side of the support or support table 2. The bracket 15, the thrust element 16 and the support roll 18 constitute displacing or displacement means for a purpose to be described hereinafter.

Figure 2:
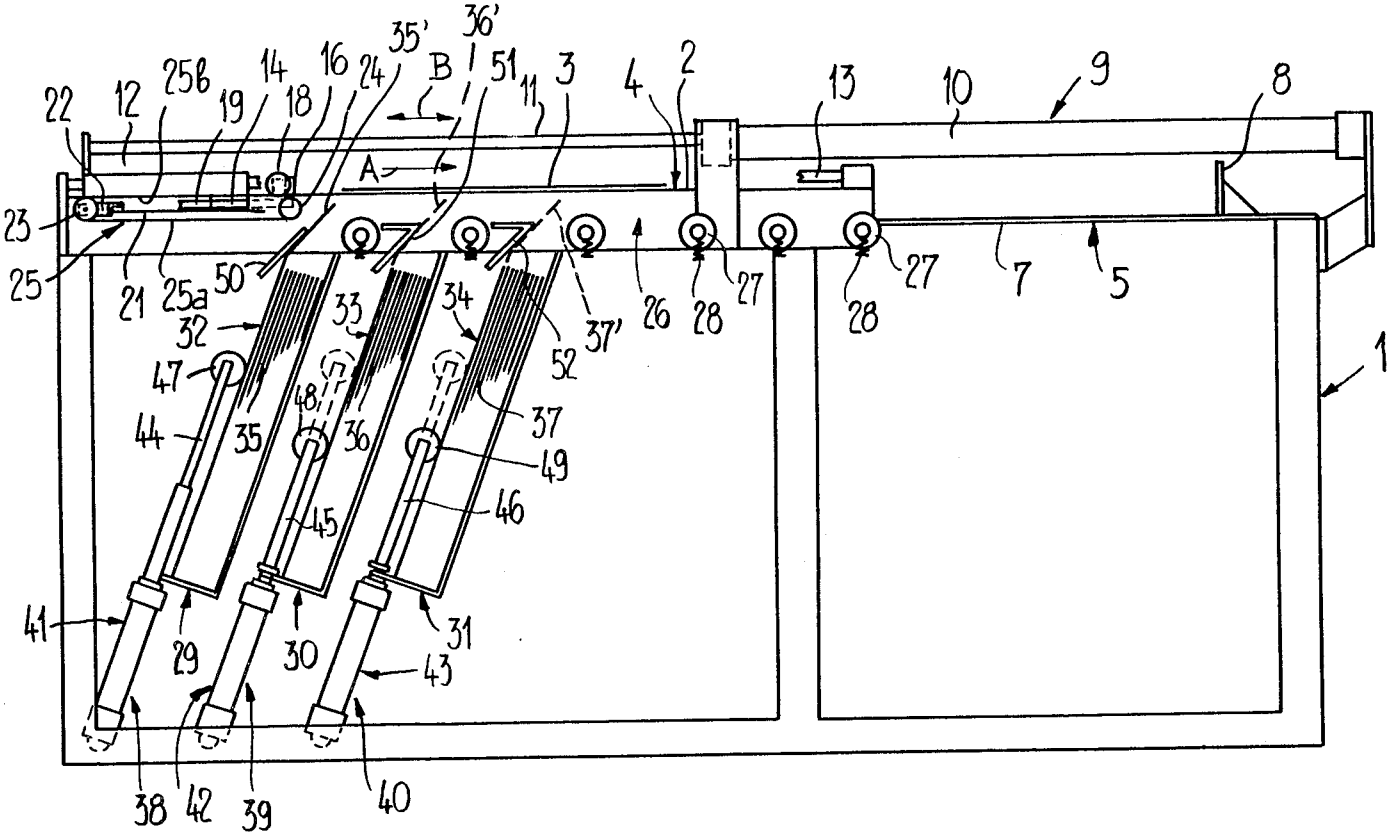
FIG. 2 is a side view of the collating apparatus shown in FIG. 1 and illustrates a first operational phase during the operation of such apparatus.

Holding means 19 for two blade spring elements 20 and 21 which extend parallel to each other, see FIG. 1, are laterally mounted at the transverse beam or carrier 14. These blade spring elements 20 and 21 each carry at one of their ends a support member 22 for a related one of two deflection rolls 23 and 24. Of these two support members 22, only the support member 22 for the deflection roll 23 is illustrated in FIG. 2.

The collecting means 14, 16, 25 further comprise an endless conveyor belt 25 which is guided at the aforementioned deflection rolls 23 and 24. The second or upper run 25*b* of this conveyor belt 25 engages the underside of the support or support table 2 and is pressed against the support or support table 2 by means of the blade spring elements 20 and 21. The opposite first or lower run 25*a* of the conveyor belt 25 forms the effective or active conveying run of the conveyor belt 25.

Below the predetermined travel path or track 4 of the cover elements or sheets 3 and also below the conveyor belt 25, there is arranged a predetermined conveying path or track 26 which extends parallel to the travel path or track 4. This conveying path or track 26 is formed by rollers 27 which are arranged parallel to one another and which are supported at only schematically indicated springs 28. Beneath this conveying path or track 26 there are arranged receiving or storage bins 29, 30, 31 accommodating respective supplies or stacks 32, 33, 34 of related additional or supplementary sheets 35, 36, 37 which constitute flat structures or entities. The receiving storages or bins 29, 30, 31 open toward their top and are series-arranged with respect to the predetermined conveying path or track 26. The additional or supplementary sheets 35, 36, 37, for example, may constitute announcement or advertising sheets for display at sales locations. The receiving or storage bins 29, 30, 31 into which removable charging inserts have been inserted, are placed in an upright position, however, are inclined to some extent relative to the vertical.

Each receiving or storage bin 29, 30, 31 is associated with a feed or outfeed mechanism 38, 39, 40 acting upon the related additional or supplementary sheets 35, 36, 37. Each of these feed or outfeed mechanisms 38, 39, 40 possesses a respective piston-cylinder unit 41, 42, 43 with a respective piston rod 44, 45, 46 carrying a respective rubber roller 47, 48, 49. These rubber rollers 47, 48, 49 may contain free wheel mechanisms which are effective when the piston rods 44, 45, 46 are retracted. When the piston rods 44, 45, 46 are extended, each respective topmost additional or supplementary sheet 35', 36', 37' is upwardly pushed or ejected into the working or operating range of the first or lower or active conveying run 25*a* of the conveyor belt 25. By means of guide elements 50, 51, 52 which are arranged above the related receiving or storage bins 29, 30, 31 the upwardly pushed additional or supplementary sheets 35', 36', 37' are deflected to some degree in a predetermined direction of movement indicated by the arrow A in FIGS. 1 and 2.

The piston-cylinder units 41, 42, 43 can be selectively controlled such that during each collating operation the desired number and type of additional or supplementary sheets 35, 36, 37 can be upwardly pushed and entrained.

The collating apparatus illustrated in FIGS. 1, 2, 3 operates as follows:

FIGS. 1 and 2 show both the thrust element 16 as well as the conveyor belt 25 in their rear end position. In this position the piston rod 11 is fully extended. On the support or support table 2 there lies a cover element or sheet 3 which is intended to be collated or assembled with at least one of the additional or supplementary sheets 35, 36, 37. By controlling the piston-cylinder units 41, 42, 43 the desired additional or supplementary sheets 35, 36, 37 are upwardly pushed. In the case illustrated in FIG. 2, only one additional or supplementary sheet, namely the topmost additional or supplementary sheet 35', is required and its front end protrudes into the working or operating range or into the predetermined direction of movement A of the conveyor belt 25.

By retracting the piston rod 11 in the direction of the arrow B both the displacing means 15, 16, 18, particularly the thrust element 16, and the collecting means 14, 16, 25, particularly the conveyor belt 25, are displaced in the predetermined direction of movement indicated by the arrow A. During such movement, the thrust element 16 pushes the cover element or sheet 3 which lies on the support or support table 2, towards the deposit device or means 5. As already mentioned, the second or upper run 25*b* of the conveyor belt 25 is pressed against the underside of the stationary support or support table 2 and rolls at the support or support table 2, whereby the conveyor belt 25 is driven in a circulating or revolving manner. The first or lower or active conveying run 25*a* of the conveyor belt 25 thus also moves in the predetermined direction of movement indicated by the arrow A.

When the conveyor belt 25 moves past the upwardly pushed additional or supplementary sheet 35', the first or lower or active conveying run 25*a* of the conveyor belt 25 withdraws or extracts this additional or supplementary sheet 35' from the stack 32 and entrains the same as well as any other additional or supplementary sheets, like the additional or supplementary sheets 36' and 37' which may have been upwardly pushed.

Since the conveyor belt 25, on the one hand, is moved or displaced at the displacement or transport speed determined by the retraction speed of the piston rod 11 and, on the other hand, also circulates at this displacement or transport speed, the additional or supplementary sheet 35' is displaced at twice the speed of the cover element or sheet 3. It is thus ensured that the additional or supplementary sheet 35' arrives at the deposit device or means 5 at least simultaneously with or even prior to the cover element or sheet 3. This is, in fact, true for all of the additional or supplementary sheets 35, 36, 37, although all these additional or supplementary sheets 35, 36, 37 must travel greater distances than the cover element or sheet 3.

Figure 3:
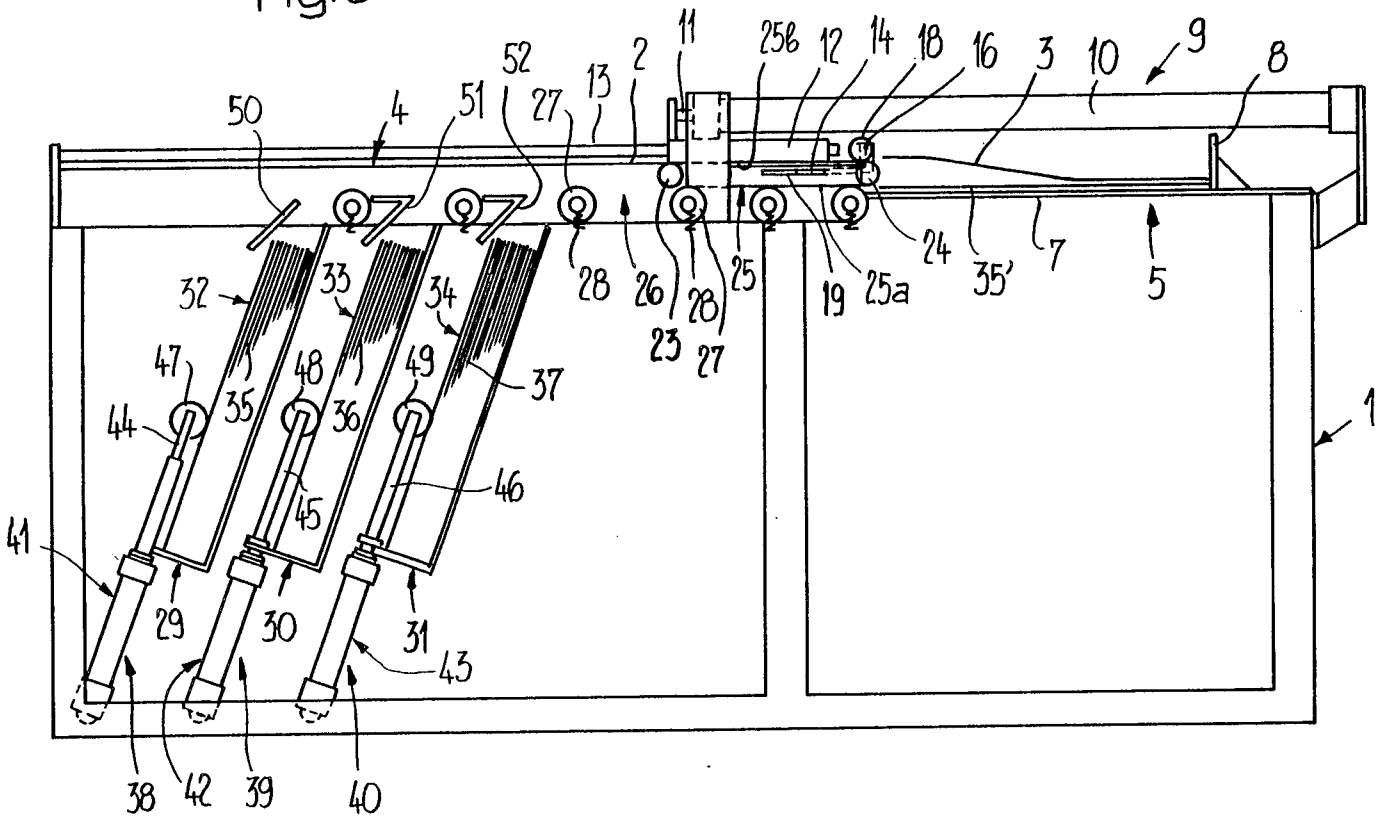
FIG. 3 is a side view similar to FIG. 2 and shows the collating apparatus during a later phase of its operation.

Consequently, the cover element or sheet 3, as desired, comes to rest on top of the collated and superposed additional or supplementary sheets 35, 36, 37, as evident from FIG. 3. In FIG. 3 the thrust element 16 and the conveyor belt 25 are shown in their forward end position. The stop 8 ensures that the superposed cover element or sheet 3 and the additional or supplementary sheet 35' are aligned with their leading edges to each other.

By extending the piston rod 11, the thrust element 16 and the conveyor belt 25 are returned into their rear end position shown in FIGS. 1 and 2. Thereafter, a further collating and assembling operation of a cover element or sheet 3' and additional or supplementary sheets 35', 36', 37' can follow.

The cover element or sheet 3 and the additional or supplementary sheet 35' which are superposed in the deposit device or means 5 are then downwardly pushed through the opening 5*a* and placed onto a printed product stack which moves below and past the deposit device or means 5. It is, however, to be understood that the superposed sheets or signatures constituted by the cover element or sheet 3 and the additional or supplementary sheet 35' can also be removed in a different manner from the deposit device or means 5.

In the above-described manner it is possible to collate or assemble sheets or signatures for other purposes. For instance, it is possible that the collated or assembled cover element and sheets or signatures 3, 35, 36, 37 can be stapled or bound or interconnected in any other suitable manner. If required, more than three receiving or storage bins can be provided.

The above-mentioned apparatus has the advantage that with the same type of additional or supplementary sheets 35, 36, 37 it is possible to use cover elements or sheets 3 of various types or various prints or imprints. Thus, final products can be produced which differ from each other in the type of the cover element or sheet 3. If not required, these cover elements or sheets 3 and thus also the thrust element 16 can be dispensed with. This would mean that only the additional or supplementary sheets 35, 36, 37 would be collated or assembled in the described manner from the receiving or storage bins 29, 30, 31 by means of the conveyor belt 25.

The herein described apparatus, of course, can be formed or constructed with respect to various parts in a manner different from that illustrated. For example, it is possible to construct the conveyor belt 25 of multiple members, i.e. arrange a number of small conveyor belts next to each other.

While there are shown and described present preferred embodiments of the invention, it is to be distinctly understood that the invention is not limited thereto, but may be otherwise variously embodied and practiced within the scope of the following claims. Accordingly,

What I claim is:

1. An apparatus for superposing flexible flat structures, especially sheets and signatures, comprising:

at least one receiving bin open toward its top;

said at least one receiving bin accommodating a supply of said flexible flat structures;

deposit means operatively associated with said at least one receiving bin and in which said flexible flat structures are collected in a superposed condition;

a predetermined conveying path leading from said at least one receiving bin to said deposit means;

said at least one receiving bin being arranged below said conveying path;

collecting means displaceable along said predetermined conveying path in order to thereby convey said flexible flat structures to said deposit means after their withdrawal from said at least one receiving bin;

said collecting means containing at least one endless conveyor belt drivable in a predetermined direction of movement;

means for driving said endless conveyor belt;

said conveyor belt defining a first run which faces said at least one receiving bin; and said first run of said conveyor belt being circulatingly drivable in said predetermined direction of movement of said conveyor belt.

2. The apparatus as defined in claim 1, further including:

a preselected structural member;

said conveyor belt defining a second run which engages said preselected structural member;

said conveyor belt being displaceable along said predetermined conveying path; and said conveyor belt being drivable due to a rolling movement of said second run of said conveyor belt while said second run of said conveyor belt engages said preselected structural member and said conveyor belt is displaced along said predetermined conveying path.

3. The apparatus as defined in claim 2, wherein:

said preselected structural member constitutes a stationary structural member.

4. The apparatus as defined in claim 1, wherein:

said at least one receiving bin constitutes a plurality of receiving bins; and said receiving bins of said plurality of receiving bins being serious-arranged with respect to said predetermined direction of movement of said conveyor belt.

5. The apparatus as defined in claim 4, wherein:

said plurality of receiving bins being arranged at an inclination relative to said predetermined conveying path.

6. The apparatus as defined in claim 1, further including:

at least one feed means;

said feed means being operatively associated with said at least one receiving bin;

said conveyor belt defining a predetermined working range; and said at least one feed means being operable to feed said flexible flat structures located in said at least one receiving bin into said predetermined working range of said conveyor belt.

7. The apparatus as defined in claim 4, further including:

a predetermined number of feed means;

each one of said predetermined number of feed means being operatively associated with a related one of said plurality of receiving bins;

said conveyor belt defining a predetermined working range; and each one of said predetermined number of feed means being operable to feed said flexible flat structures located in said related receiving bin into said predetermined working range of said conveyor belt.

8. The apparatus as defined in claim 1, further including:

a support arranged above said conveyor belt;

said support receiving further ones of said flexible flat structures and defining a predetermined travel path which leads to said deposit means; and displacing means for displacing said further flexible flat structures along said predetermined travel path to said deposit means.

9. The apparatus as defined in claim 8, wherein:

said displacing means contain a thrust element.

10. The apparatus as defined in claim 3, further including:

a support arranged above said conveyor belt;

said support constituting said stationary structural member;

said support receiving further ones of said flexible flat structures and defining a predetermined travel path which leads to said deposit means; and displacing means for displacing said further flexible flat structures along said predetermined travel path to said deposit means.

11. The apparatus as defined in claim 10, further including:

drive means conjointly operatively associated with said conveyor belt and with said displacing means;

said drive means displacing said conveyor belt along said predetermined conveying path; and said drive means also displacing said displacing means in order to thereby displace said further flexible flat structures along said predetermined travel path to said deposit means.

12. The apparatus as defined in claim 11, wherein:

said drive means conjointly and operatively associated with said conveyor belt and with said displacing means, constitute a piston-cylinder unit;

said displacing means containing a thrust element; and said piston-cylinder unit, during its operation, reciprocating said thrust element of said displacing means and said conveyor belt.

* * * * *

UNITED STATES PATENT AND TRADEMARK OFFICE

CERTIFICATE OF CORRECTION

PATENT NO. : 4,616,816

DATED : October 14, 1986

INVENTOR(S) : HANS-ULRICH STAUBER

It is certified that error appears in the above—identified patent and that said Letters Patent is hereby corrected as shown below:

Column 1, line 68, please delete "at" and insert --as--

Column 7, line 7, please delete "serious-arranged" and insert --series-arranged--

Signed and Sealed this

Sixth Day of January, 1987

*Attest:*

DONALD J. QUIGG

*Attesting Officer*

*Commissioner of Patents and Trademarks*